US007303421B2

(12) United States Patent
Liao

(10) Patent No.: US 7,303,421 B2
(45) Date of Patent: Dec. 4, 2007

(54) TERMINALS FOR ELECTRICAL CONNECTOR

(75) Inventor: Chi-Nan Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/519,473

(22) Filed: Sep. 12, 2006

(65) Prior Publication Data

US 2007/0059966 A1 Mar. 15, 2007

(30) Foreign Application Priority Data

Sep. 12, 2005 (TW) ..... 94131247 A

(51) Int. Cl.
*H01R 11/22* (2006.01)

(52) U.S. Cl. ..... 439/342; 439/857

(58) Field of Classification Search ..... 439/342, 439/857, 856

See application file for complete search history.

(56) References Cited

U.S. PATENT DOCUMENTS 6,319,038 B1 * 11/2001 Howell et al. ..... 439/342
6,450,826 B1 * 9/2002 Howell et al. ..... 439/342
6,461,183 B1 * 10/2002 Ohkita et al. ..... 439/342
6,638,119 B1 * 10/2003 Chang ..... 439/857
6,830,471 B2 * 12/2004 Okita et al. ..... 439/342
6,908,328 B2 * 6/2005 Lei et al. ..... 439/342
6,979,219 B2 * 12/2005 Scholz ..... 439/342
7,137,841 B1 * 11/2006 Liao et al. ..... 439/342

* cited by examiner

*Primary Examiner*—Gary Paumen
(74) *Attorney, Agent, or Firm*—Wei Te Chung

(57) ABSTRACT

A terminals (10) for use in connection of a first electrical interface (50) and a second interface (60), comprises a base portion (12) extending between the first electrical interface and the second electrical interface, a pair of arm portions (14) extending from two lateral sides of the base portion toward the first electrical interface, a solder portion (16) extending outwardly from the base portion (12) towards the second electrical interface, and at least one plate-like member disposed between the arm portion (14) and the solder portion (16) of the terminal (10).

20 Claims, 6 Drawing Sheets

TERMINALS FOR ELECTRICAL CONNECTOR

BACKGROUND OF THE INVENTION

1. Field of the Invention

The present invention relates generally to terminals for connecting a first electrical interface to a second interface, such as a chip module to a printed circuit board (PCB), for providing a better circuit connection.

2. Background of the Invention

Integrated circuit (IC) devices, especially pin grid array (PGA) devices, are widely used in a zero insertion force connector or a low insertion force connector for building a signal transmission circuit between leads of a chip module and corresponding welding points of a printed circuit board. Conventional terminal having high contact performance described in U.S. Pat. Nos. 6,319,038 and 6,830,471 comprise a base portion extending uprightly, a pair of arm portions extending upwardly from the two sides of the base portion and bent opposite to each other, a solder portion disposed on a distal of the base portion, respectively. In use, the base portion of the terminal is positioned in corresponding receive holes of the insulative housing, and the arm portions are sandwiched between the leads of the chip module and the solder portions soldered with the contact pads of the printed circuit board; therefore, electrical connection between the chip module and the printed circuit board is achieved.

In order to enable high frequency signal transmission reliably between the chip module and the printed circuit board, matched impedance of the terminals to the leads of the chip module and the welded points of the printed circuit board should be met. However, said terminals described in the prior arts at least exist the following flaws: the impedance of the socket connector only relies upon the mechanical features of the base portion, the arm portion and the solder portion, which is difficult to match the impedance of the chip module and the printed circuit board. Moreover, while the developing trend of the socket connectors is high density and compact type, and the distances between the terminals of become narrower and narrower, which will produce signal disturbance between two adjacent terminals during signal transmission.

In view of the above, it is desired to provide a new socket connector to overcome the above-mentioned disadvantages.

SUMMARY OF THE INVENTION

A primary object of a preferred embodiment of the present invention is to provide a terminal having a better electrical characteristic enabling reliable signal transmission circuit between two electrical surfaces.

To achieve the above object, the present invention provides a terminal applied for signal transmission circuit between a first electrical surface and a second electrical interface. The terminal comprises a base portion extending between the first electrical interface and the second electrical interface, a pair of arm portions extending from two lateral sides of the base portion toward the first electrical interface, a solder portion extending from the base portion towards the second electrical interface, and at least two plate-like member disposed between the arm portion and the solder portion of the terminal.

Compared with the conventional the socket connector, the terminal of the present invention comprises at least the following merits: during the signal transmitting, the capacitive effect produced by the plate-like members disposed between the first electrical interface and the second electrical interface can adjust the impedance of the terminals, so the match between the terminal and the electrical interface is realized. In addition, the plate-like member may improve the shielding efficacy so that the signal interference between two adjacent terminals during the signal transmission can be prevented.

Other features and advantages of embodiments of the present invention will become more apparent to those skilled in the art upon examination of the following drawings and detailed description of preferred embodiments, in which:

DETAILED DESCRIPTION OF THE PREFERRED EMBODIMENTS

Reference will now be made to describe preferred embodiments of the present invention in detail.

Four preferred embodiments of a terminal of the invention are illustrated in FIGS. 1-6. The terminal is to connect a first electrical interface to a second electrical interface, such as a chip module 50 and a printed circuit board 60.

Figure 1:
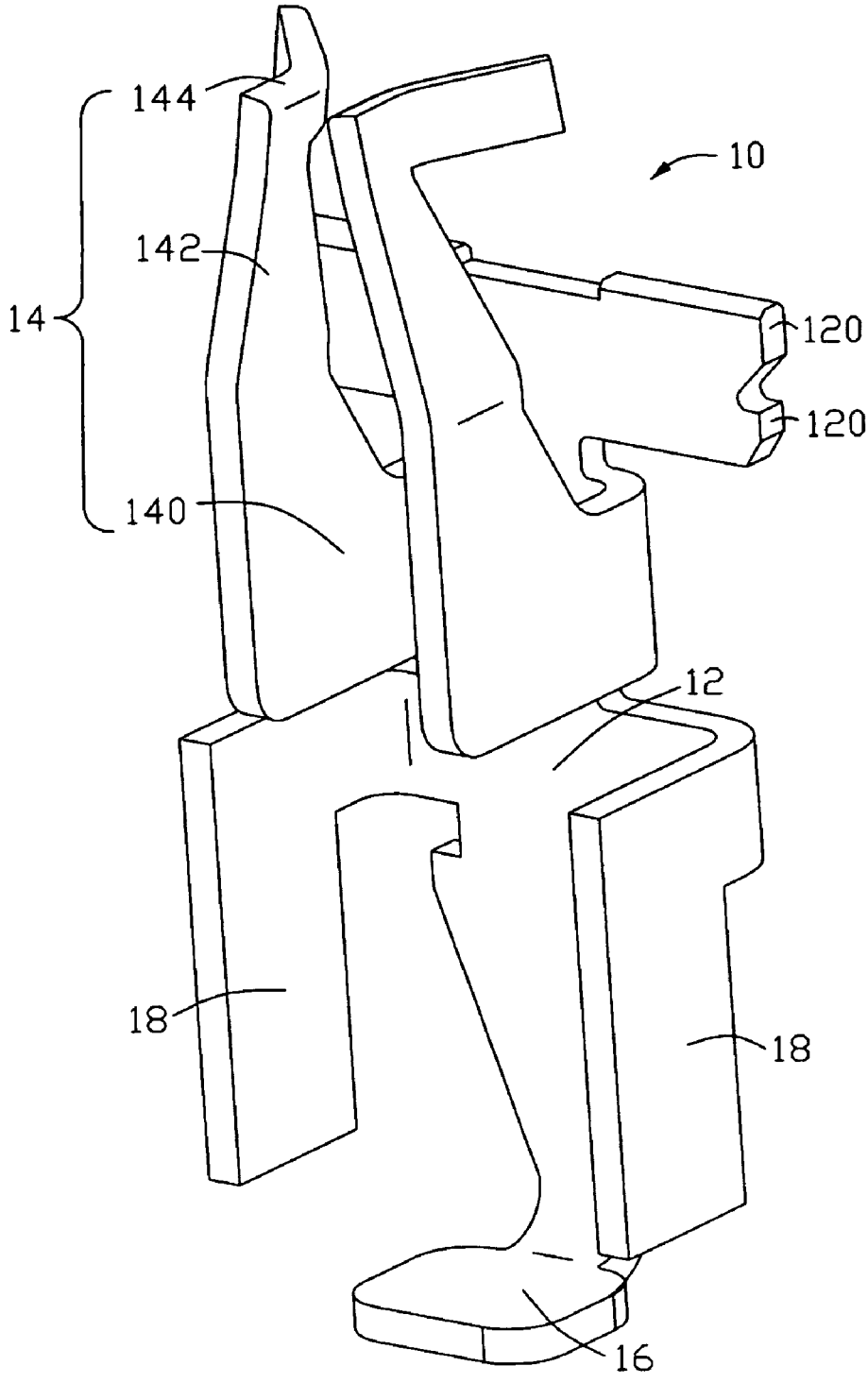
FIG. 1 is an isometric view of a terminal in accordance with a first preferred embodiment of the present invention.
Figure 2:
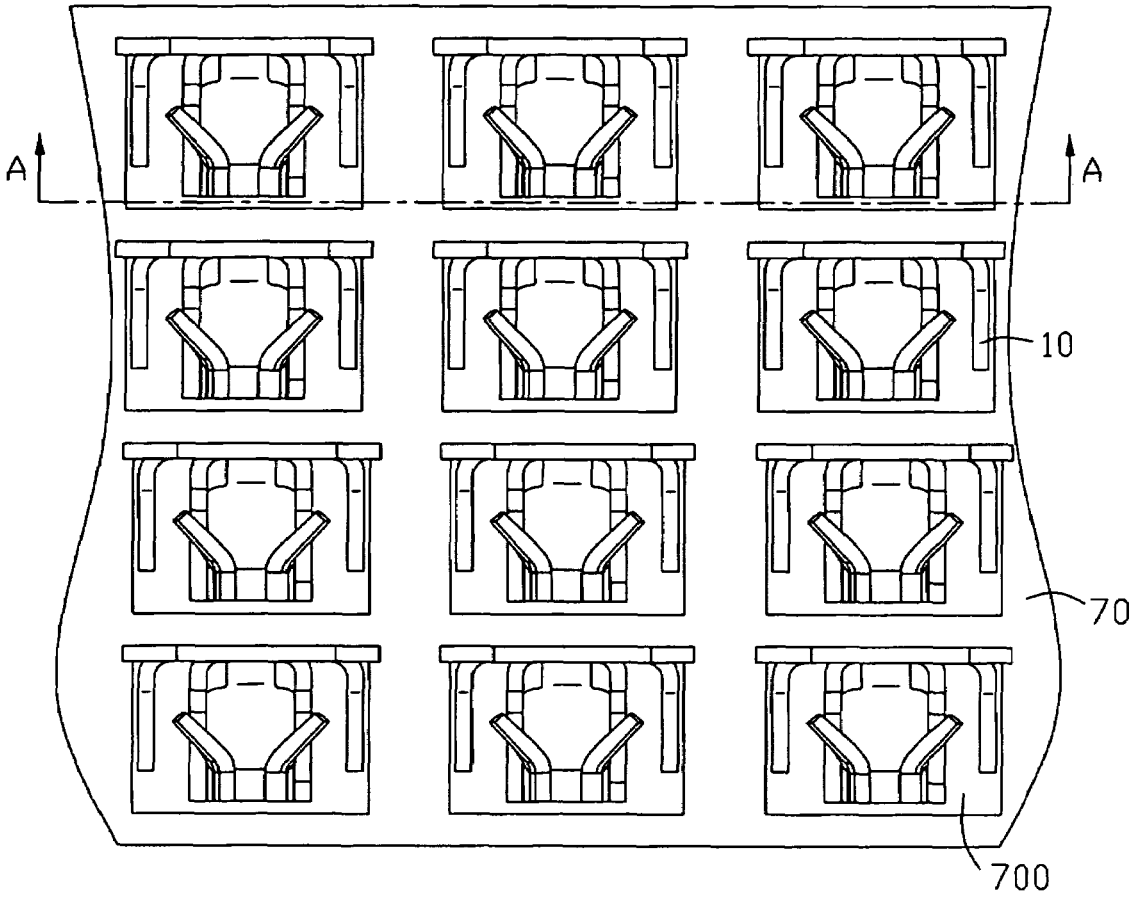
FIG. 2 is partial top view of the terminals received in a housing.
Figure 3:
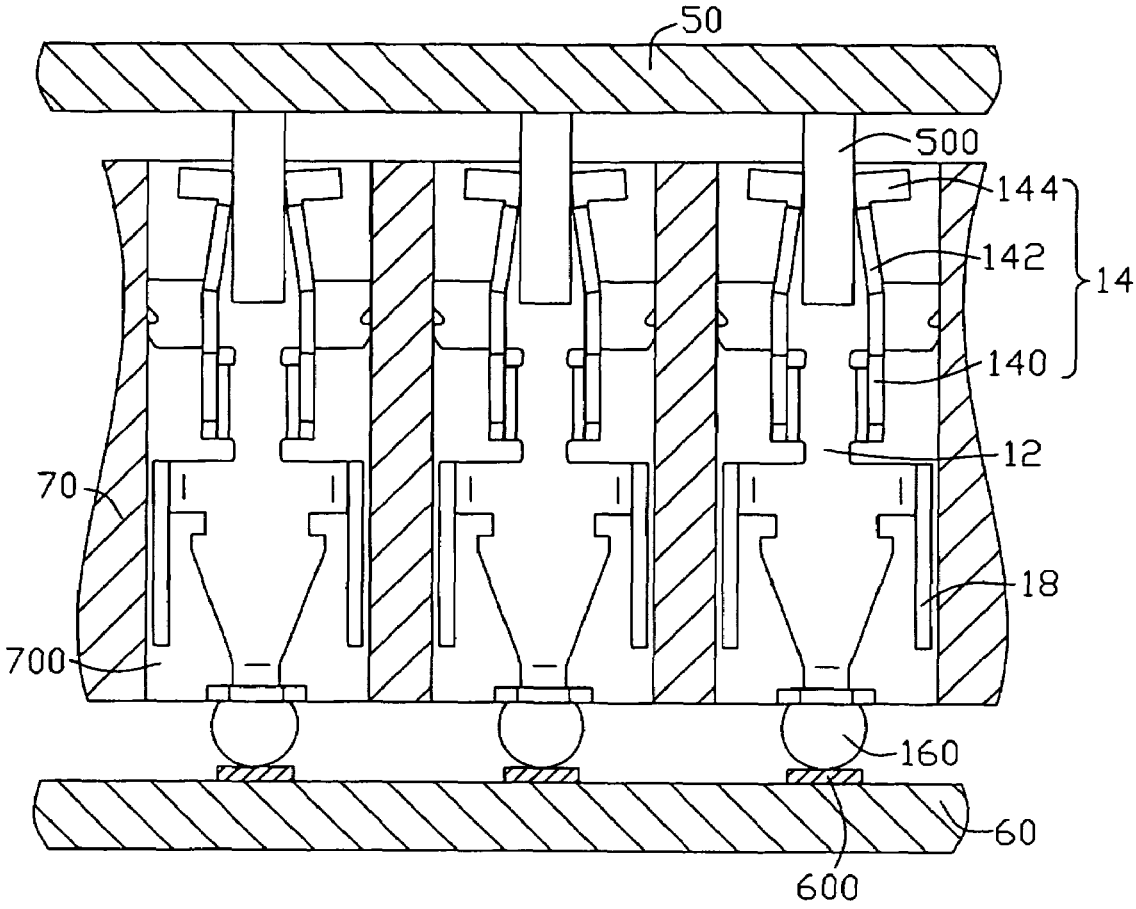
FIG. 3 is cross sectional view of the terminals received in the housing.

A first preferred embodiment of a terminal 10 in accordance with the invention is shown in FIG. 1-3. Each terminal 10 integrally forms a base portion 12, a pair of arm portions 14 extending upwardly from the base portion 12 and bent oppositely with each other, a solder portion 16 extending perpendicularly from a distal end of the base portion 12 and a pair of plate-like members 18 disposed oppositely on two sides of the base portion 12.

Turning to FIG. 1, the base portion 12 is plate-like, and comprises a plurality of barbs 120 formed on two lateral sides thereof, for holding the terminal 10 stably. The arm portions 14 are defined arcuately on two sides of base portion 10 and comprise a connection arm 140 extending perpendicularly from two sides of the base portion 10, an extending arm 142 extending from an end of the connection arm 140 far from the base portion 10 and inclined inward and upward, and a contact portion 146 extending perpendicularly from an top end of the extending arm 142 to the base portion 10. The contact arm 146 is formed smooth and extends outwardly, which is of advantage to the engagement between leads 500 of the chip module and the contacts arm 144 of the terminals 10.

The solder portion 16 extends perpendicularly from a distal end of the base portion 12 for attaching solder balls 160 for connecting with the corresponding contact pads 600 of the printed circuit board 60. The base portion 12 defines a pair of plate-like members 18 bent from the two sides thereof between the arm portion 14 and the solder portion 16. The plate-like members 18 that are disposed parallel to each other extend from the base portion 12 perpendicularly and a certain distance is determined between the top end, the distal end and the connection arm 140, the solder portion 16 respectively.

Then referring to FIG. 2 in conjunction with FIG. 3, the assembling process of the terminals 10 and the housing 70 is described as following: while the terminals 10 are inserted into the corresponding passageways 700 of the housing 70 along a top-to-bottom direction, the base portion 12 abuts against backwalls of the passageways 700 and the barbs 120 defined at the two side of the base portion 12 interferentially engages with the sidewalls of the passageways 700. Especially, referring to FIG. 3, after the terminals 10 are inserted into the passageway 700 of the housing 70 completely, the plate-like members 18 do not contact with the inner walls of the passageways 700.

The plate-like members 18 can produce the capacitive effect during the signal transmission, which can adjust the impedance of the terminal 10 to match the impedance between the terminal 10, the chip module 50 and the printed circuit board 60, so that transmission of high frequency signal can be realized. Furthermore, the plate-like members 18 parallel to each other can enhance the shielding efficiency of the terminals 10, which can prevent the signal disturbance produced in the process of the signal transmission.

Figure 4:
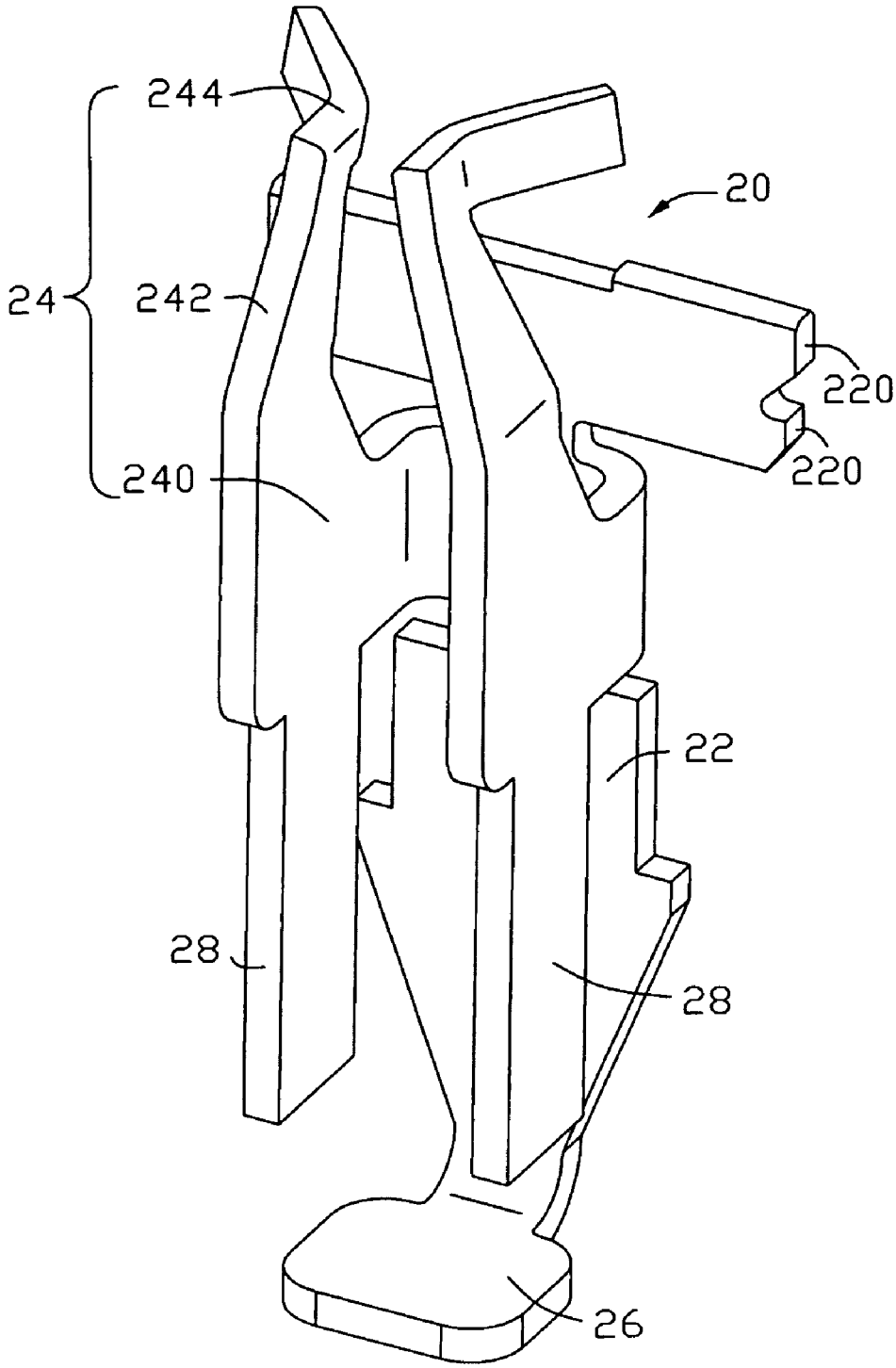
FIG. 4 is an isometric view of a terminal in accordance with a second preferred embodiment of the present invention.

A terminal 20 in accordance with a second embodiment of the invention shown in FIG. 4, comprises a plate-like base portion 222 extending along a vertical direction, an arm portion 24 extending upwardly from two sides of the base portion 22 and bending oppositely with each other, a solder portion 26 extending horizontally from a distal end of the base portion 22. Two sides of the base portion 22 define pairs of barbs 220 adjacent a top end thereof for holding the terminal 20 steadily. The arm portion 24 defines a connection arm 240, an extending arm 242 extending arcuately from an end of the connection arm 240 far away from the base portion 22 oppositely upwardly and inwardly, a contact arm 244 extending horizontally from a top end of the extending arm 242 to the base portion 22. The contact arm 244 defines a smooth curve interface and extends outwardly. Each of the lower ends of the connection arm 240 defines a plate-like member 28, respectively. The plate-like members 28 disposed oppositely extend a distance along the extending direction of the base portion 22 toward the solder portion 26. The plate-like members 28 disposed oppositely can produce the capacity efficiency during the signal transmission, which may adjust the impedance of the terminal 20 and meet the need of the high frequency signal transmission. Furthermore, the plate-like members parallel to each other can enhance the shielding efficiency of the terminal 20, which can prevent the signal interference produced in the process of the signal transmission.

Figure 5:
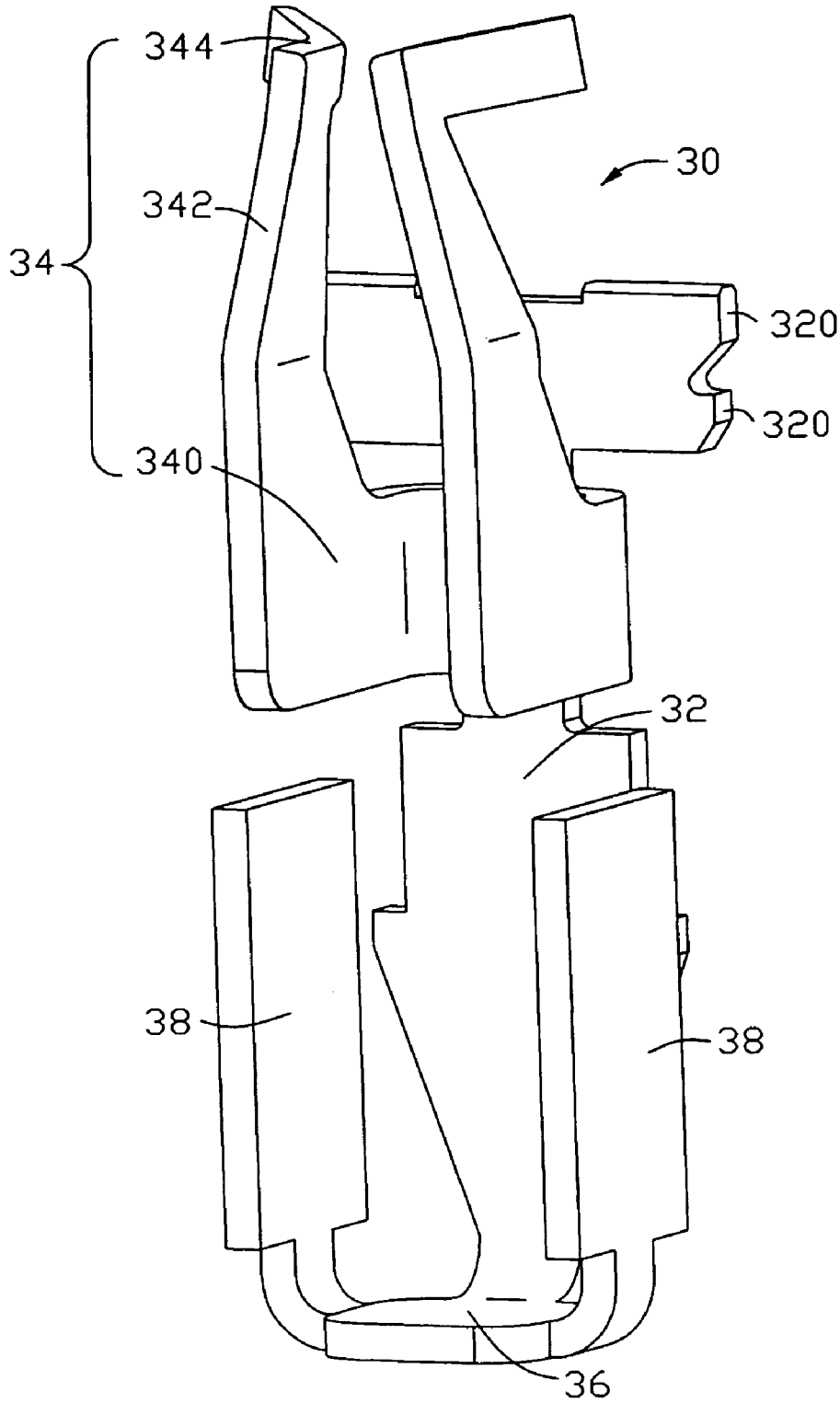
FIG. 5 is an isometric view of a terminal in accordance with a third preferred embodiment of the present invention.

Referring to the FIG. 5, a third embodiment of a terminal 30 of the invention is described, The terminal 30 defines a plate-like base portion 32 extending uprightly. A plurality of barbs 320 for holding the terminals 32 reliably is disposed on the top end of the base portion's opposite sides. A pair of arm portions 34 is disposed on two opposite sides of the base portion 32 extending uprightly and bent oppositely. Each arm portion 34 comprises a connection arm 340 connecting with a lateral side of the base portion 32, an extending arm 342 extending from an end of the connection 340 arm far away from the base portion 32 bent inwardly and upwardly, a contact arm 344 extending from the top end of the extending arm 342 to the base portion 32 horizontally. The contact arm 344 is provided with a smooth curved interface extending towards the base portion 32 outwardly. A horizontal solder portion 36 is disposed on a lower end of the base portion 32. Each lateral side of the solder portion 36 sides defines a plate-like member 38 extending upwardly therefrom. A plane defined by the plate-like members 38 is vertical to a plane defined by the base portion 32. A certain distance is predetermined between the top end and a lower side of the connection arm 340 in an upright direction. The plate-like members 38 extending parallel from two opposite sides of the solder portion 36 can produce a capacity efficiency, so that the impedance of the terminal 30 can be adjusted, which can meet the need of the transmission of the high frequency of the signal, and furthermore the plate-like member 38 can enhance the shielding ability, which can prevent the disturbance of the adjacent terminals 30 during the signal transmission.

Figure 6:
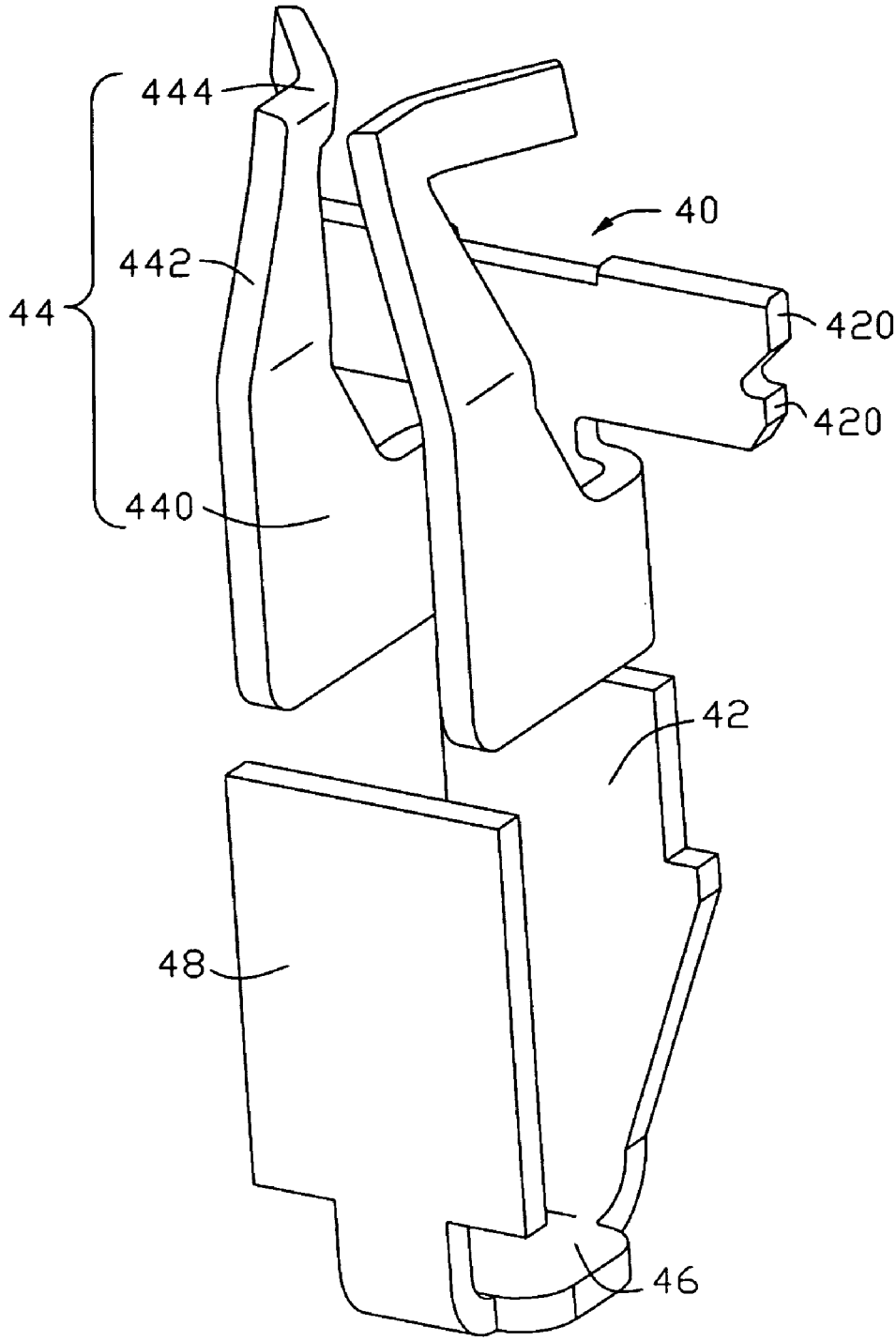
FIG. 6 is an isometric view of a terminal in accordance with a fourth preferred embodiment of the present invention.

FIG. 6 is an isometric view of a terminal 40 of a fourth embodiment. Each terminal 40 defines a plate-like base portion 42 extending from the upright direction, a pair of arm portions 44 extending from two sides of the base portion 42 and bent oppositely and a solder portion 46 extending horizontally and perpendicularly to a distal end of the base portion 42. A plurality of the barbs 420 is disposed on preferred positions of the two sides of the base portion 42 for holding the terminal 40 steadily. The arm portion 44 comprise a connection arm 440 connecting with the base portion 42, an extending arm 442 extending from an end of the connection 440 arm far away from the base portion 42 bent inwardly and upwardly and a contact arm with smooth curved interface extending outwardly in a direction of the base position 42 and connecting with the extending portion 442. A pair of plate-like members 48 is formed on the sides of solder portion 46 opposite to the base portion 42. The plate-like members 48 is disposed parallel to the base portion 42. The plate-like members 48 extending from the solder portion 46 is disposed opposite to the base portion 42, which can produce the capacitive effect during the signal transmission, so that the impedance of the terminals 40 can be adjusted and furthermore the plate-like members disposed opposite can enhance the shielding ability, which can prevent the disturbance of the adjacent terminals during the signal transmission.

It is noted that although all embodiments of the terminals of the invention are all illustrated in a zero insertion force connector, the thought of the invention can also be fit for the low insertion force connector. In the low insertion force connector, the base portion, the solder portion and the plate-like members disposed oppositely are disposed similarly to the corresponding part of the terminal of the zero insertion force connector. In the low insertion force connector, the arm portion comprise a connector arm extending from the base portion, an extending arm extending from an end of the connector arm far away from the base portion bent inwardly and upwardly, the extending arm defining a contact arm extending in the extending direction of the base portion, and the contact arm is configured as a pair of arms bent outwardly with each other and transitions to the extending arm with a smoothly curved surface. The plate-like members disposed opposite can adjust the impedance of the terminals and enhance the shielding ability, which can prevent the disturbance of the adjacent terminals during the signal transmission.

Furthermore, size, shape and distance of the two plate-like members can be adjusted for obtaining a better match of the impedance of terminal. The plate-like members can be disposed far away from the housing undertaking no mechanical character in the embodiments of the invention. During the designing of the terminals, the mechanical characteristic can be firstly met, and then the real need of the electrical character can be attained by adjusting size, position of the plate-like members, whereby the design of the terminals can be simplified.

While the present invention has been described with reference to specific embodiments, the description of the embodiments is illustrative, but not to be construed as limiting the invention. Various of modifications to the present invention can be made to the preferred embodiments by those skilled in the art without departing from the true spirit and scope of the invention as defined by the appended claims.

What is claimed is:

1. A terminal received in a housing of a socket connector for connecting a first electrical interface to a second electrical interface comprising:

a base portion extending between the first electrical surface and the second electrical surface;

a pair of arm portions extending from the base portion toward the first electrical surface and beyond a upper end of the base portion; and a solder portion extending from the base portion toward the second electrical surface; wherein at least one plate-like member is provided between the arm portion and the solder portion, and said at least one plate-like member is located in a plane perpendicular to a plane defined by the solder portion.

2. The terminal as claimed in claim 1, wherein there are two plate-like members extending from the base portion toward the second electrical surface and the plate-like members are disposed spaced away from the arm portions.

3. The terminal as claimed in claim 1, wherein there are two plate-like members extending from lower ends of the arm portions toward the second electrical surface.

4. The terminal as claimed in claim 1, wherein the solder portion extends perpendicular to the base portion, and there are two plate-like members extending from the solder portion towards the first electrical surface, each plate-like member being located in a plane perpendicular to a plane defined by the base portion.

5. The terminal as claimed in claim 1, wherein the solder portion extends horizontally from the base portion, and the at least one plate-like member extends from the solder portion towards the first electrical surface.

6. The terminal as claimed in claim 1, wherein, when the terminal is inserted into the housing, the at least one plate-like member is disposed clear off the housing.

7. The terminal as claimed in claim 1, wherein the arm portion defines a connection arm extending from the base portion, an extending arm extending from an end of the connection arm far away from the base portion towards the first electrical interface, and a contact arm extending from a distal end of the extending arm horizontally.

8. The terminal as claimed in claim 7, wherein the contact arm extends from the extending arm outwardly and defines a smoothly curved surface.

9. The terminal as claimed in claim 1, wherein there are two plate-like members extending from the lower end of the arm portions, and the two plate-like members are parallel to each other.

10. The terminal as claimed in claim 9, wherein a distance between the two plate-like members is no less than that between the lower ends of the two arm portions.

11. An electrical connector comprising:

an insulative housing defining a plurality of passageways extending between upper and bottom surfaces of the housing;

a plurality of contacts disposed in the corresponding passageways, respectively;

each of said contacts including:

a base portion extending between the upper surface and the lower surface;

a pair of arm portions extending from an upper section of the base portion and toward the upper surface; and a horizontal solder portion extending from a bottom end of the base portion and toward the bottom; wherein at least one plate-like member is provided beside a lower section of the base portion, and said at least one late-like member is located in a plane perpendicular to a plane defined by the solder portion.

12. The connector as claimed in claim 11, wherein said plate-like is opposite to the lower section of the base portion.

13. The connector as claimed in claim 11, wherein the plate-like member extends from the horizontal solder portion.

14. The connector as claimed in claim 11, wherein said plate-like member extends from one end of the arm portions.

15. The connector as claimed in claim 11, wherein said plate-like member extends from the lower section of the base portion.

16. The connector as claimed in claim 11, wherein there are two of said plate-like members, and said two plate-like members are opposite to each other along a same direction as that of the pair of arms portions.

17. The connector as claimed in claim 16, wherein a distance between said two plate-like members along said direction is larger than that between any portions of said pair of arms portions along said direction.

18. The connector as claimed in claim 11, wherein a retention portion is formed in the upper end of the pair of arms portions.

19. The connector as claimed in claim 11, wherein a contact region is defined between said pair of arms portions, far away from the base portion.

20. The connector as claimed in claim 16, wherein said two plate-like members are parallel to each other.

* * * * *